US006643491B2

(12) United States Patent
Kinouchi et al.

(10) Patent No.: US 6,643,491 B2
(45) Date of Patent: Nov. 4, 2003

(54) HEATING MECHANISM FOR USE IN IMAGE FORMING APPARATUS

(75) Inventors: Satoshi Kinouchi, Tokyo (JP); Osamu Takagi, Chofu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,301

(22) Filed: Nov. 2, 2001

(65) Prior Publication Data

US 2002/0051663 A1 May 2, 2002

Related U.S. Application Data

(63) Continuation-in-part of application No. 09/699,472, filed on Oct. 31, 2000, now abandoned.

(51) Int. Cl.[7] ..... G03G 15/20

(52) U.S. Cl. ..... 399/330; 219/216; 219/619; 399/33; 399/333

(58) Field of Search ..... 399/330, 333, 399/328, 33, 69; 219/619, 469, 216; 430/99, 124; 118/60

(56) References Cited

U.S. PATENT DOCUMENTS

| | | | | |
|---|---|---|---|---|
| 5,970,299 A | | 10/1999 | Sano et al. | 399/330 |
| 6,026,273 A | | 2/2000 | Kinouchi et al. | 399/328 |
| 6,078,781 A | | 6/2000 | Takagi et al. | 399/330 |
| 6,087,641 A | | 7/2000 | Kinouchi et al. | 219/619 |
| 6,097,926 A | | 8/2000 | Takagi et al. | 399/328 |
| 6,137,985 A | | 10/2000 | Kinouchi et al. | 399/329 |
| 6,154,629 A | | 11/2000 | Kinouchi et al. | 399/329 |
| 6,169,871 B1 | * | 1/2001 | Higaya | 219/619 |
| 6,262,404 B1 | | 7/2001 | Higaya et al. | 219/619 |

FOREIGN PATENT DOCUMENTS

| | | |
|---|---|---|
| JP | 8-76620 | 3/1996 |
| JP | 9-258586 | 10/1997 |
| JP | 10-111610 | 4/1998 |
| JP | 2000-275996 | * 10/2000 |

OTHER PUBLICATIONS

U.S. patent application Ser. No. 09/472,819, Takagi et al., filed Dec. 28, 1999.
U.S. patent application Ser. No. 09/473,058, Takagi et al., filed Dec. 28, 1999.
U.S. patent application Ser. No. 09/666,786, Kinouchi et al., filed Sep. 21, 2000.
U.S. patent application Ser. No. 09/667,782, Takagi et al., Sep. 22, 2000.

* cited by examiner

*Primary Examiner*—Sophia S. Chen
(74) *Attorney, Agent, or Firm*—Foley & Lardner

(57) ABSTRACT

Disclosed is a fixing apparatus in which a cylindrical roller having a thin metal layer is heated by an induction heating. In order to shorten the rising time required for elevating the temperature from the stopped state to a predetermined temperature in fixing a toner image transferred onto a paper sheet to the paper sheet, a coil covering member is arranged within the heating roller between an exciting coil and the inner wall of the heating roller, the coil covering member being colored in a color effective for reflecting the infrared ray radiated from the heating roller toward the heating roller. The coil covering member is formed of a material exhibiting electrical insulating properties and heat insulating properties and having a small heat capacity.

18 Claims, 9 Drawing Sheets

HEATING MECHANISM FOR USE IN IMAGE FORMING APPARATUS

CROSS-REFERENCE TO RELATED APPLICATIONS

This is a Continuation-in-Part application of U.S. patent application Ser. No. 09/699,472, filed Oct. 31, 2000, now abandoned, the entire contents of which are incorporated herein by reference.

BACKGROUND OF THE INVENTION

The present invention relates to a heating apparatus utilizing an induction heating, particularly, to a fixing apparatus used in, for example, an electrophotographic copying apparatus or a printer apparatus using a toner as a visualizing agent so as to fix the toner image.

In a fixing apparatus incorporated in a copying apparatus using an electrophotographic process, a developing agent image, i.e., a toner image, formed on a transferred material is melted by heating so as to permit the toner image to be fixed to the transferred material. Various methods of heating the toner, which can be employed in a fixing apparatus, have been put to a practical use including, for example, a method utilizing a radiation heat radiated from a halogen lamp (filament lamp), a flash heating method utilizing a flash lamp as the heat source, an oven heating method for heating the entire fixing portion with a heat source, and a hot plate heating system in which plates having a transferred material sandwiched therebetween are heated, a toner image being formed on said transferred material.

In the method using a halogen lamp as a heat source, it is widely known to the art to use a pair of rollers arranged to be capable of applying a predetermined pressure to the transferred material and the toner held therebetween. In this case, at least one of the rollers is formed hollow and a columnar halogen lamp is arranged within the inner space of the hollow roller. In the method of using a halogen lamp, a nip portion is formed between the hollow roller having the halogen lamp arranged therein and the other roller, i.e., a pressurizing roller, and these two rollers are rotated to permit the transferred material having a toner image formed thereon to be guided into the nip portion, with the result that pressure and heat are applied to the transferred material having a toner image formed thereon.

To be more specific, the transferred material, e.g., a paper sheet, having a toner image formed thereon is guided to the nip portion between the hollow heating roller having a halogen lamp arranged therein and the rotating pressurizing roller so as to melt the toner on the paper sheet and, thus, to fix the toner image to the paper sheet.

In the fixing apparatus using a halogen lamp, however, the light and the infrared rays are radiated from the halogen lamp in the entire circumferential direction of the heating roller so as to heat the entire heating roller. As a result, the heat conversion efficiency is 60 to 70% because of the loss in the conversion of the light into heat and the efficiency of warming the air within the heating roller and transmitting the heat to the heating roller, leading to a large power consumption. In addition, a long warming time is required.

Under the circumstances, an improved fixing apparatus has been proposed in recent years. Specifically, it is proposed that a thin heat resistant film movable in tight contact with a heating body is formed into an endless belt or a cylinder, and a material to be heated, which is in tight contact with the heat resistant film, is moved together with the film so as to permit the film to impart the heat energy of the heating body to the material to be heated. Incidentally, the heat resistant film has in general a width conforming with the maximum width of the transferred material. It follows that, in the fixing apparatus using the particular film, it is necessary to control the temperature to be uniform in the longitudinal direction of the heating body. As a result, the uniformity in the manufacturing step and the temperature control with a high accuracy in the operating step are required, leading to an increased manufacturing cost of the apparatus.

Incidentally, when it comes to a high speed copying machine capable of making a large number of copies per unit time, the heating time is shortened in general. As a result, it is necessary to use a heating body having a large heat capacity, leading to an increased power consumption. Also, the total power consumption is rendered unduly large so as to give rise to an inconvenience in terms of the safety standards.

In order to overcome the above-noted problems inherent in the heater fixation and the film fixation, a fixing apparatus using an induction heating is proposed in, for example, Japanese Patent Disclosure (Kokai) No. 9-258586 and Japanese Patent Disclosure No. 8-76620.

Specifically, Japanese Patent Disclosure No. 9-258586 discloses a fixing apparatus, in which an electric current is allowed to flow through an induction coil prepared by winding a coil about a core arranged along the rotary shaft of the fixing roller made of a metal so as to generate an induction current in the roller and, thus, to permit the metal roller itself to generate heat.

On the other hand, Japanese Patent Disclosure No. 8-76620 discloses a fixing apparatus comprising a conductive film having a magnetic field generating means housed therein and a pressurizing roller that is in tight contact with the conductive film. In this prior art, heat is generated from the conductive film so as to permit the toner image formed on a transferred material, which is transferred through the clearance between the conductive film and the pressurizing roller, to be fixed to the transferred material.

In the fixing apparatus of the induction heating system described above, the heating coil acting as a magnetic field generating means is arranged inside the heating roller. In many cases, the gap between the heating coil and the heating roller is very small. Therefore, many examples are reported in which the surface of the heating coil is covered with an insulating material in order to prevent the heating roller from being brought into contact with the heating coil and, thus, to prevent the heating coil from being broken. Incidentally, Japanese Patent Disclosure No. 10-111610 discloses an example that the insulating material is thermally shrinkable so as to fix the heating coil. It is possible to prevent the breakage of the heating coil and a short circuit caused by the contact between the heating roller and the coil by covering the heating coil with an insulating material.

However, in a high speed machine having a large number of output recording material sheets per unit time, the heating roller is rotated at a high speed. Therefore, where the heating coil is covered with an insulating material as described above, it is necessary to increase the thickness of the insulating material layer so as to ensure safety. This implies that the heat capacity of the insulating material is increased. It should be noted in this connection that the fixing apparatus utilizing the induction heating is required to produce the merit that the warm up time is short. In the prior art, however, the heat of the infrared ray radiated from the heating roller when the heating roller is heated and released toward the insulating material and the heating coil is absorbed by the insulating material. It follows that the warm up time is increased with increase in the heat capacity of the insulating material.

BRIEF SUMMARY OF THE INVENTION

An object of the present invention is to provide a fixing apparatus of an induction heating system capable of shortening the warm up time while allowing the insulating material layer interposed between the heating coil and the heating roller to have a thickness large enough to ensure high insulating properties.

Another object of the present invention is to provide a fixing apparatus of an induction heating system, in which the heat generated from the heating roller is released inside the heating roller so as to prevent the temperature elevation of the heating coil.

According to a first aspect of the present invention, there is provided a fixing apparatus, comprising: a first hollow cylindrical rotor rotatable in an optional direction; a second rotor brought into contact with a single point on the outer circumferential surface of the first rotor with a predetermined contact pressure so as to be rotated in accordance with rotation of the first roller, a nip portion into which a transferred material is supplied being formed in the contact portion between the first and second rotors; an induction heating apparatus arranged within the first rotor so as to impart a magnetic flux to the first rotor and, thus, to generate an eddy current within the first rotor, thereby generating heat; and a covering member having a predetermined color effective for reflecting the infrared ray radiated from the first rotor and arranged between the first rotor and the induction heating apparatus so as to prevent the first rotor from being brought into direct contact with the induction heating apparatus.

According to a second aspect of the present invention, there is provided a fixing apparatus, comprising: a first hollow cylindrical rotor rotatable in an optional direction; a second rotor brought into contact with a single point on the outer circumferential surface of the first rotor with a predetermined contact pressure so as to be rotated in accordance with rotation of the first roller, a nip portion into which a transferred material is supplied being formed in the contact portion between the first and second rotors; an induction heating apparatus arranged within the first rotor so as to impart a magnetic flux to the first rotor and, thus, to generate an eddy current within the first rotor, thereby generating heat; a first covering member having a predetermined color effective for reflecting the infrared ray and arranged in the free space between the first rotor and the induction heating apparatus so as to prevent the first rotor from being brought into direct contact with the induction heating apparatus; and a second covering member having a predetermined color effective for reflecting the infrared ray and arranged in the free space between the first covering member and the induction heating apparatus so as to prevent the first rotor from being brought into direct contact with the induction heating apparatus.

Further, according to a third aspect of the present invention, there is provided a fixing apparatus for an electrophotographic apparatus, in which an AC current is supplied to an electromagnetic induction coil arranged in close proximity to an endless member having a metal layer formed of a conductor so as to generate heat in the endless member for heating a transferred material to which a toner image is fixed, comprising:

a coil member support member for supporting the coil member of the induction heating apparatus; and an adhesive layer for fixing the coil member to the coil member supporting member.

DETAILED DESCRIPTION OF THE INVENTION

A digital copying apparatus will now be described with reference to the accompanying drawings as an example of the image forming apparatus to which is applied the technical idea of the present invention.

Figure 1:
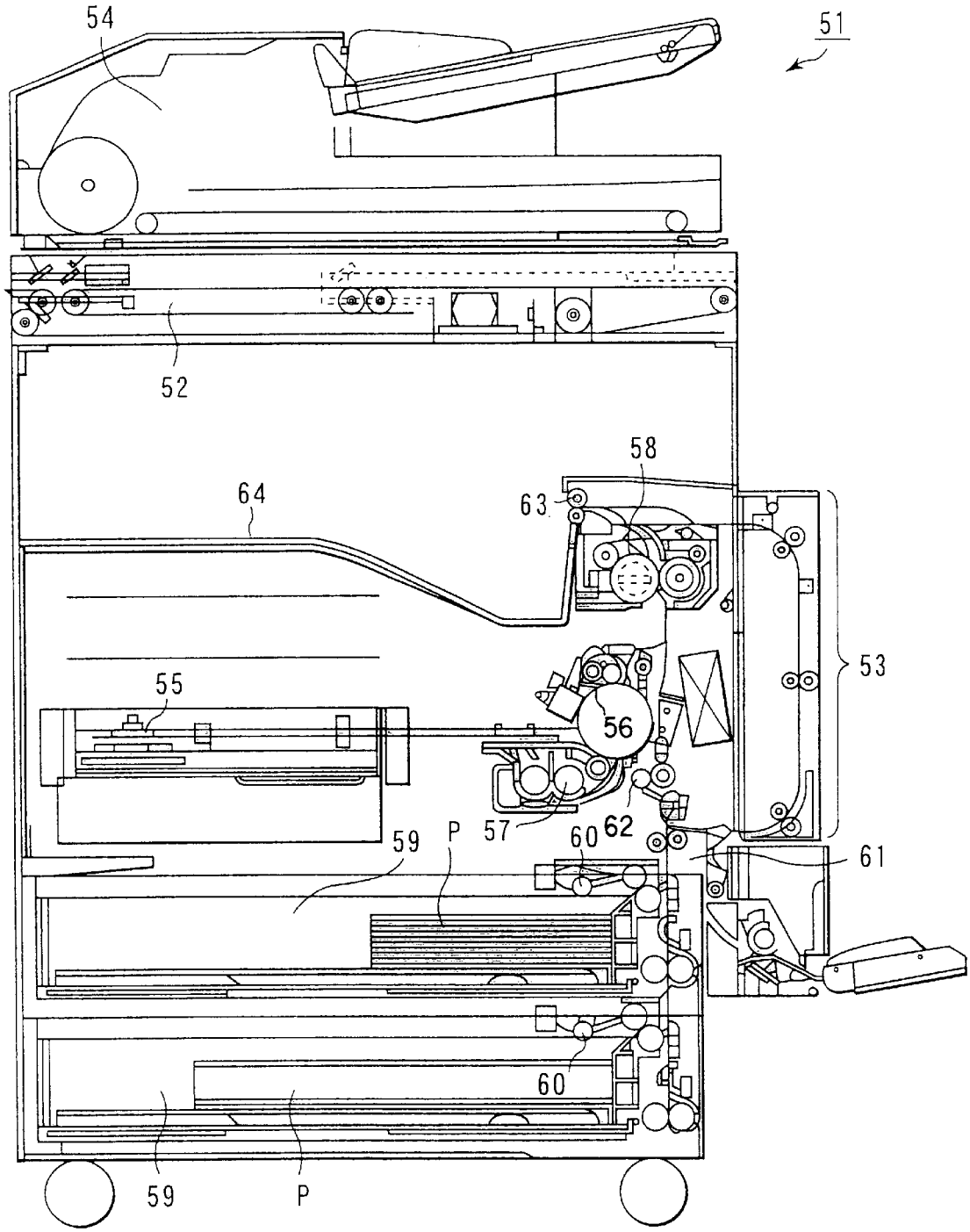
FIG. 1 schematically exemplifies the construction of an image forming apparatus in which an induction heating type fixing apparatus of the present invention is incorporated.

Specifically, FIG. 1 shows a digital copying apparatus (image forming apparatus) 51 of the present invention. As shown in the drawing, the digital copying apparatus 51 has an image reading apparatus (scanner) 52 serving to grasp a subject image as a brightness-darkness of light and to convert the grasped light into an electric signal so as to form an image signal, and an image forming section 53 for forming an image corresponding to the image signal supplied from the scanner 52 or from the outside and for fixing the formed image to a paper sheet P used as a transferred material (transferred material). Incidentally, an automatic original feeding apparatus (ADF) 54 is integrally mounted to the scanner 52. Where the copying object is in the form of a sheet, the automatic original feeding apparatus 54 is interlocked with the image reading operation of the scanner 52 so as to renew successively the copying object.

The image forming section 53 has, for example, a light exposure apparatus 55 for emitting a laser beam corresponding to the image information supplied from the scanner 52 or from an external apparatus, a photosensitive drum 56 for holding a latent image corresponding to the laser beam emitted from the light exposure apparatus 55, a developing apparatus 57 for supplying a developing agent (toner) to the latent image formed on the photosensitive drum 56 for developing the latent image, and a fixing apparatus 58 for fixing the toner image formed by the developing apparatus 57 on the photosensitive drum 56, said toner image being transferred onto a transferred material P by a paper feeding section which is to be described herein later, to the transferred material P by melting the toner image, which is electrostatically attached to the transferred material P, by heating and, then, pressurizing the molten toner image to the transferred material P.

When an image signal is supplied from the scanner 52 or from an external apparatus in the image forming apparatus of the construction described above, the photosensitive drum 56 charged to a predetermined potential is irradiated with a laser beam (not shown) having the intensity modulated to conform with the image signal supplied from the light exposure apparatus 55. As a result, an electrostatic latent image conforming with the image to be copied (to be outputted) is formed on the photosensitive drum 56.

The electrostatic latent image formed on the photosensitive drum 56 is developed with the toner supplied selectively from the developing apparatus 57, with the result that the electrostatic latent image is converted into a toner image (not shown).

The toner image formed on the photosensitive drum 56 is transferred onto a paper sheet P supplied from a paper sheet cassette 59 holding the paper sheets P acting as the transferred materials to the transfer position. The paper sheet P is taken up one by one from the paper cassette 59 by a pickup roller 60 so as to be transferred along a transfer path 61 formed between the photosensitive drum 56 and the cassette 59. The paper sheet P is further transferred to the transfer position for transferring the toner image onto the paper sheet P by an aligning roller 62 for aligning the paper position with the toner image formed on the photosensitive drum 56.

The paper sheet P having the toner image transferred thereonto by the transfer apparatus is transferred to the fixing apparatus 58. The toner image on the paper sheet P is melted in the fixing apparatus 58 and, then, pressure is applied to the molten toner image so as to fix the toner image to the paper sheet P.

The paper sheet P having the toner image fixed thereto in the fixing apparatus 58 is transferred through a paper discharge roller 63 into a discharge space (paper discharge tray) 64 defined between the scanner 52 and the paper sheet cassette 59.

Figure 2:
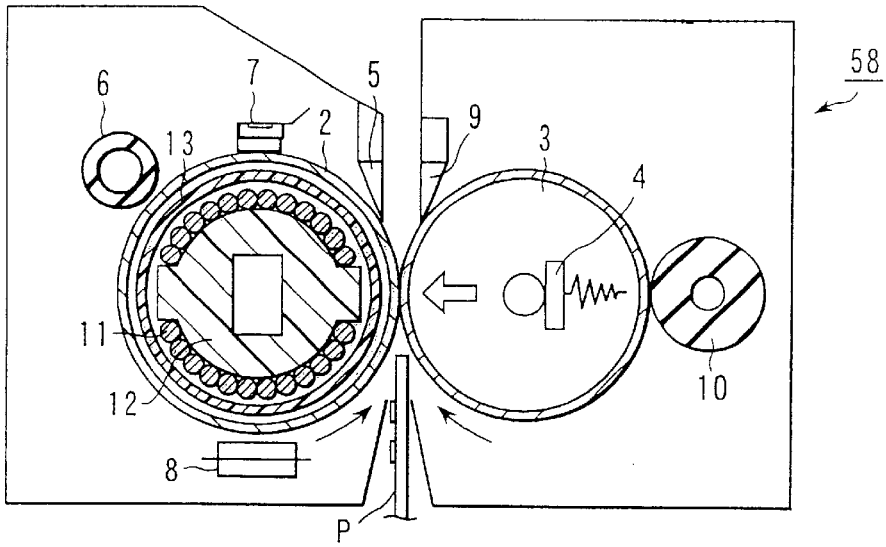
FIG. 2 is a cross sectional view schematically exemplifying the construction of an induction heating type fixing apparatus of the present invention, which is incorporated in the image forming apparatus shown in FIG. 1.
Figure 3A:
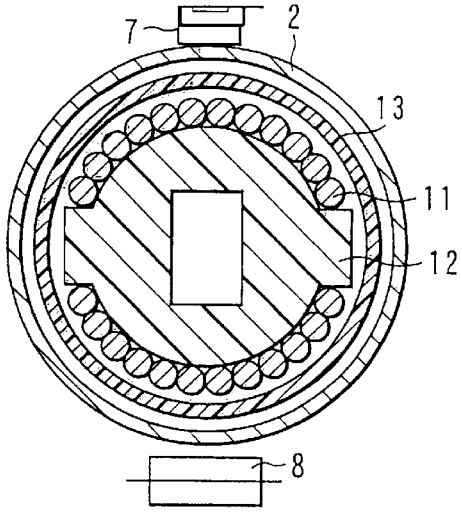
FIG. 3A is a cross sectional view showing in a magnified fashion the heating roller of the fixing apparatus shown in FIG. 2.
Figure 3B:
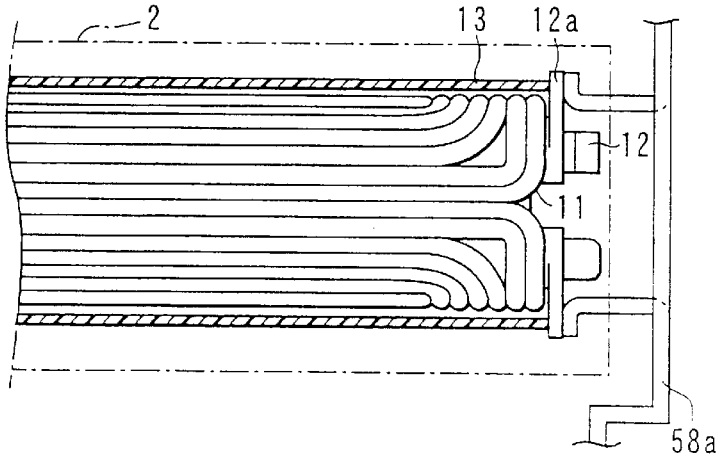
FIG. 3B schematically shows the feature in the shape of the edge portion of the support member of the heating roller shown in FIG. 3A.
Figure 3C:
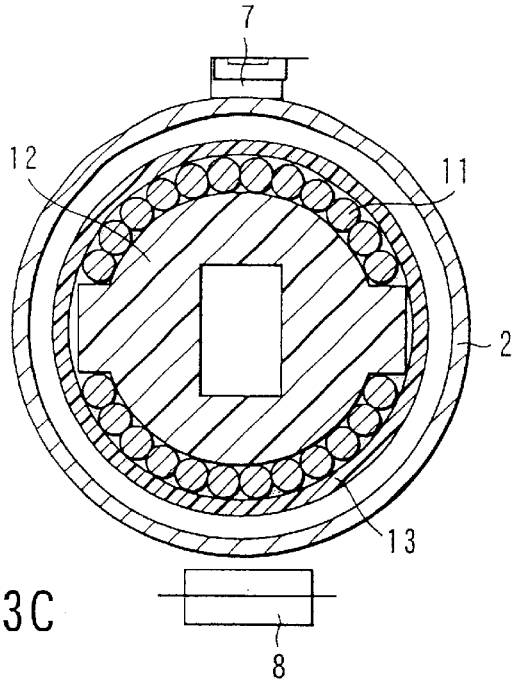
FIG. 3C schematically shows a modification of the heating roller shown in FIG. 3A.

FIG. 2 is a cross sectional view schematically showing the fixing apparatus incorporated in the image forming apparatus shown in FIG. 1. Also, FIG. 3A is a cross sectional view showing in a magnified fashion the heating roller included in the fixing apparatus shown in FIG. 2. Incidentally, FIG. 3B schematically shows the roller holding section for holding the heating roller shown in FIG. 3A. Further, FIG. 3C shows a modification of the heating roller shown in FIG. 3A.

The fixing apparatus 58 has a first cylindrical roller (heating roller) 2 made of a metal sheet having a thickness of about 1 mm, and having a diameter of about 40 mm and a length of about 340 mm, and a second roller (pressurizing roller) 3 having a diameter of about 40 mm and a length of about 320 mm. The pressurizing roller 3 is arranged in the longitudinal direction of the heating roller 2 such that the axis of the pressurizing roller 3 is in parallel to the axis of the heating roller 2 and is brought into contact with a single point on the circumferential surface of the heating roller 2. It is possible to use, for example, a pure iron, stainless steel, aluminum, and an alloy between stainless steel and aluminum for forming the heating roller 2. Also, a releasing layer made of a fluorine-containing resin represented by "Teflon" (trade name of polytetrafluoroethylene) is formed on the surface of the heating roller 2 in order to prevent the toner from being attached to the surface of the heating roller 2. On the other hand, the pressurizing roller 3 is formed of an elastic roller consisting of a shaft having a predetermined diameter and a silicone rubber layer or a fluorine-containing rubber layer formed to cover the outer surface of the shaft.

The pressurizing roller 3 is pushed with a predetermined pressure by a pressurizing mechanism 4 toward the heating roller 2. As a result, the pressurizing roller 3 is temporarily deformed to form a nip portion for holding a transferred material between the pressurizing roller 3 and the heating roller 2. In other words, a predetermined pressure is applied to a transferred material of a paper sheet P supplied to the nip portion. The heating roller 2 is rotated by a driving motor (not shown) at a predetermined speed such that the outer circumferential surface of the heating roller 2 is moved at a peripheral speed substantially equal to that of the outer circumferential surface of the photosensitive drum included in the image forming section. The pressurizing roller 3 is also rotated in accordance with rotation of the heating roller 2 such that the peripheral speed of the outer circumferential surface of the pressurizing roller 3 is equal to that of the outer circumferential surface of the heating roller 2.

A peeling claw 5 for peeling the paper sheet P from the heating roller 2, a cleaning member 6 for removing the toner attached to the surface of the heating roller 2 and the paper dust generated from the paper sheet P, a thermistor 7 for detecting the temperature on the surface of the heating roller 2, and a thermostat 8 for detecting the abnormality in the surface temperature of the heating roller 2 so as to stop the heating (to shut off the current supply) are arranged on the outer circumferential surface of the heating roller 2 in positions downstream of the nip portion between the heating roller 2 and the pressurizing roller 3 in the rotating direction of these rollers 2 and 3. On the other hand, a peeling claw 9 for peeling the paper sheet P from the pressurizing roller 3 and a cleaning member 10 for removing the toner attached to the surface of the pressurizing roller 3 are arranged on the outer circumferential surface of the pressurizing roller 3.

An exciting coil 11 is arranged inside the heating roller 2 along the inner surface of the roller 2. The exciting coil 11 is formed of an empty coil that does not include a ferrite core or an iron core in which the magnetic flux generated from the coil 11 is concentrated, and is fixed at a predetermined position inside the heating roller 2 by a support member 12 made of, for example, a PEEK (polyether ether ketone) material, a phenolic material or an engineering plastic material having a high resistance to heat such as an unsaturated polyester. Also, the position of the support member 12 is defined such that the support member 12 can be supported by a holder (sheet metal) or a resin holder (not shown) for supporting the heating roller 2 in a manner to prevent the exciting coil 11 from being brought into contact with the inner circumferential surface of the heating roller 2. Since an empty coil is used as the exciting coil 11, it is possible to save the cost required for the core material having a complex shape. Also, the use of an empty coil as the exciting coil 11 permits producing the merit of lowering the manufacturing cost of the exciting circuit.

A Litz wire prepared by bundling a plurality of copper wires each having a diameter of 0.5 mm and each covered with a heat resistant insulating layer of polyamide is used as the exciting coil 11. In this embodiment, the Litz wire is formed by bundling 16 pieces of insulated copper wires. Where the exciting coil is formed of a Litz wire as in the present invention, it is possible to make the wire diameter smaller than the permeating depth of the skin effect that is generated when an AC current having a high frequency is allowed to flow through the coil. It follows that it is possible to allow a high frequency current to flow through the exciting coil 11.

The surface of the exciting coil 11 is covered with an insulating covering member 13 having a predetermined thickness in order to maintain insulation between the exciting coil 11 and the heating roller 2. The insulating covering member 13 is made of a heat resistant resin. In this embodiment, PET (polyethylene terephthalate resin) is formed into a tube for preparing the covering member 13. It is also possible to use, for example, a fluorine-containing resin, PI (polyimide resin), PPS (polyphenylene sulfide), or a silicone rubber for forming the covering member 13. Incidentally, the covering member 13 is colored white or gray so as to permit the covering member 13 to reflect the infrared ray with a high reflectivity. The thickness of the covering member 13 is set at 0.3 mm in order to prevent the exciting coil 11 from being broken by contact with the heating roller 2 or to prevent the covering member 13 from being peeled off in the step of renewing the exciting coil 11. Also, the length of the covering member 13 should be shorter than the entire length of the heating roller 2 and should be long enough to cover completely the length of the exciting coil 11 in the longitudinal direction. Incidentally, the covering member 13 tends to move within the heating roller 2 in the axial direction of the heating roller 2 because of the difference between the inner diameter of the covering member 13 and the outer diameter of the exciting coil 11. In order to prevent the difficulty, a flange portion 12*a* having a diameter larger than the outermost diameter of the winding of the exciting coil 11 is formed in the edge portion of the support member 12. As a result, even if the covering member 13 is moved within the heating roller 2, it is possible to prevent a metal plate member 58*a* forming a structure for rotatably supporting the heating roller 2 from being brought into contact with the covering member 13. It follows that no damage is done to the covering member 13. Also, in order to prevent the covering member 13 from being moved within the heating roller 2 in the longitudinal direction of the heating roller 2, it is possible to make the inner diameter of the covering member 13 smaller than the outermost diameter of the winding of the exciting coil 11 and, thus, to permit the covering member 13 to be fitted over the exciting coil 11 under a pressurized state, as shown in FIG. 3C. It is also possible to prepare the covering member 13 by forming a thermally shrinkable material into a tube so as to bring the resultant covering member 13 into tight contact with the outermost circumferential surface of the exciting coil 11.

Figure 3D:
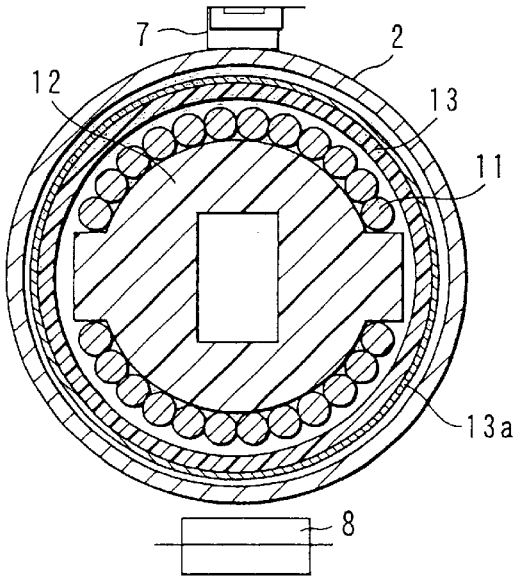
FIGS. 3D and 3E show modifications of the heating roller shown in FIG. 3A.

As shown in FIG. 3D, the covering member 13 may be provided with a mirror-like member 13*a* integral therewith. The mirror-like member 13*a* has a surface color owned by solid color. A surface roughness Rz of a surface of the cover member 13 is 6.3 μm or less. The mirror-like member 13*a* is preferably made of a metal member which is as flat as possible and has a surface roughness Rz of 6.3 μm or less. More preferably, the roughness Rz of the surface of the metal member is 1 μm or less. The thickness of the mirror-member like 13*a* is preferably 10 μm or less. More preferably, the thickness of the mirror like member 13*a* is 1 μm or less.

As the cover member 13 on which the mirror member 13*a* is integrally formed by vapor deposition for film like, preferably.

Figure 3E:
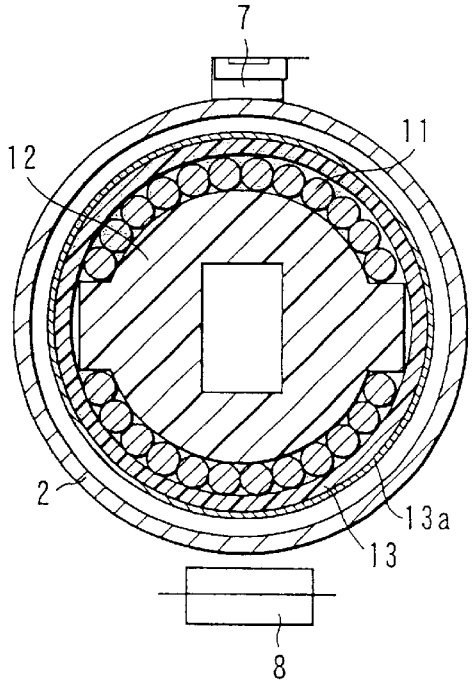

As shown in FIG. 3E, the cover member 13 having the mirror member 13*a* thereon may be in tight contact with the coil 11.

The paper sheet P having a toner image transferred thereto, said toner image being formed in the image forming section included in the image forming apparatus shown in FIG. 1, is guided to the nip portion between the heating roller 2 and the pressurizing roller 3. As a result, the toner image formed on the paper sheet P is melted and the molten toner image is fixed to the paper sheet P by the pressure between the heating roller 2 and the pressurizing roller 3.

Figure 4:
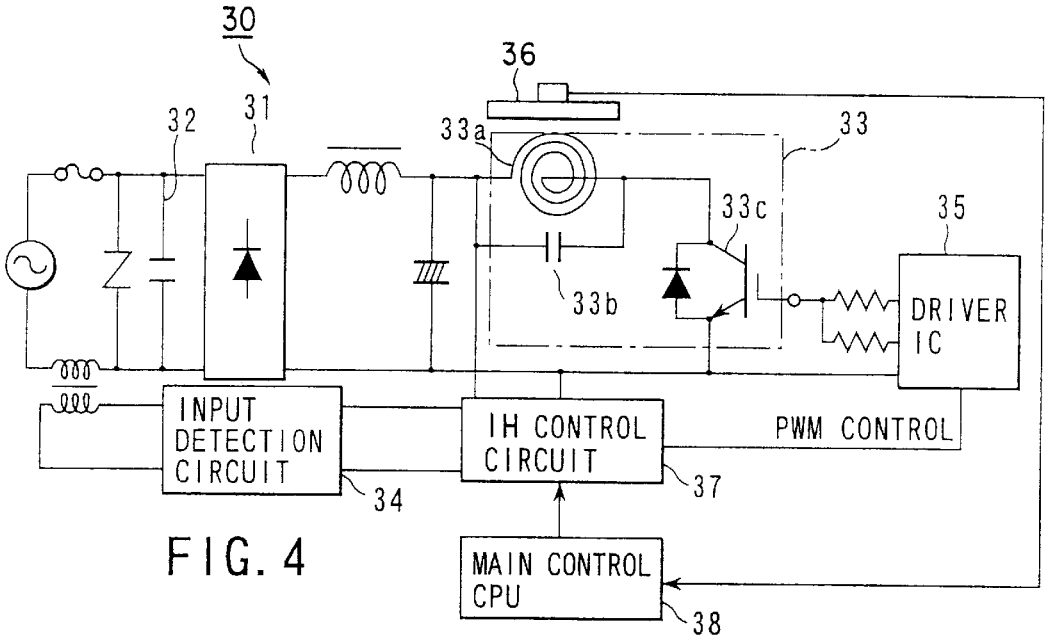
FIG. 4 is a block diagram for explaining the driving circuit for driving the fixing apparatus shown in FIG. 2.

FIG. 4 is a block diagram schematically showing a driving circuit 30 for driving the fixing apparatus shown in FIG. 2. The driving circuit 30 serves to supply a high frequency current to an exciting coil 33*a*, which corresponds to the exciting coil 11 shown in FIGS. 2 and 3. Specifically, the current obtained by rectifying the AC current from a commercial power source by a rectifying circuit 31 and a smoothing capacitor 32 is converted into a high frequency current by an inverter circuit 33 has a resonant capacitor 33*b* and a switching circuit 33*c*. The high frequency current thus obtained is supplied to the exciting coil 33*a*. Incidentally, the magnitude of the high frequency current can be controlled by making the ON time, during which the switching element 35 is kept turned on, variable by the PWM (pulse width control) based on the result of detection by an input detection means 34. In this step, the driving frequency is changed.

Also, it is possible to input the information from a temperature detector 36, which corresponds to the thermistor 7 shown in FIGS. 2 and 3A, for detecting the coil temperature and the roller temperature directly to an IH (induction heating) circuit 37. Alternatively, it is possible to input the information from the temperature detector 36 to a CPU 38 as in the present invention and, then, to the IH circuit 37 via a D/A converter (not shown) as an ON/OFF instruction.

If a high frequency current is applied to the exciting coil 11 of the fixing apparatus 58, a magnetic flux and an eddy current are caused to be generated within the heating roller 2 by the magnetic flux generated by the current flowing through the coil 11 in a manner to obstruct the change in the magnetic field. A Joule heat is generated by the eddy current and the resistance of the heating roller 2 itself so as to heat the heating roller 2. Incidentally, in this embodiment, a high frequency current having a frequency of, for example, 25 kHz and an output of 900 W is allowed to flow through the exciting coil 11.

As described above, a predetermined high frequency current is supplied from the driving circuit shown in FIG. 4 to the exciting coil 11 of the fixing apparatus 58 shown in FIGS. 2, 3A, 3B and 3C. As a result, the surface temperature of the heating roller 2 is elevated to 180° C. and the elevated temperature is maintained. In this step, the surface temperature of the heating roller 2 is detected by the thermistor 7, and the detected temperature is fed back so as to turn the high frequency current supplied to the exciting coil 11 ON/OFF, thereby maintaining substantially constant the temperature of the heating roller 2.

In order to fix the toner image to the paper sheet P, it is necessary to maintain substantially constant the temperature of the heating roller 2 over the entire region of the heating roller 2 in the circumferential direction. However, where the heating roller 2 is not rotated, the temperature distribution in the circumferential direction of the heating roller 2 is rendered nonuniform, i.e., the temperature is rendered nonuniform in the circumferential direction of the heating roller 2. The difficulty is brought about by the phenomenon that the magnetic flux is generated in a different intensity in the circumferential direction because of the reason inherent in the case of using an empty coil as the exciting coil 11 as in this embodiment.

Under the circumstances, it is necessary to narrow the temperature difference in the circumferential direction of the heating roller 2 to fall within a predetermined allowable range by the time immediately before the paper sheet P passes through the nip portion formed between the heating roller 2 and the pressurizing roller 3. Therefore, the heating roller 2 and the pressurizing roller 3 are rotated in order to make uniform the temperature distribution over the entire outer circumferential regions of these rollers 2 and 3 a predetermined time later, though the heating roller 2 and the pressurizing roller 3 are left stopped at, for example, the rising time of the fixing apparatus at which the current supply to the exciting coil 11 is started. As a result, a predetermined amount of heat is imparted to the entire outer circumferential region of each of these rollers 2 and 3.

The toner image formed in the image forming section is transferred at a predetermined timing at which the surface temperature of the heating roller 2 is elevated to reach 180° C., and the paper sheet P having the toner image electrostatically held thereon is transferred to the nip portion between the heating roller 2 and the pressurizing roller 3. When the paper sheet P passes through the nip portion, the toner image transferred onto the paper sheet P is fused and fixed to the paper sheet P.

To be more specific, a high frequency current is supplied to the exciting coil 11 by the driving circuit shown in FIG. 4. As a result, an eddy current is generated on the surface of the heating roller 2 by the magnetic field generated from the exciting coil 11 so as to generate the Joule current in the heating roller 2, thereby heating the heating roller 2. By this heating, the surface temperature of the heating roller 2 is maintained at, for example, 180° C.

Figure 5:
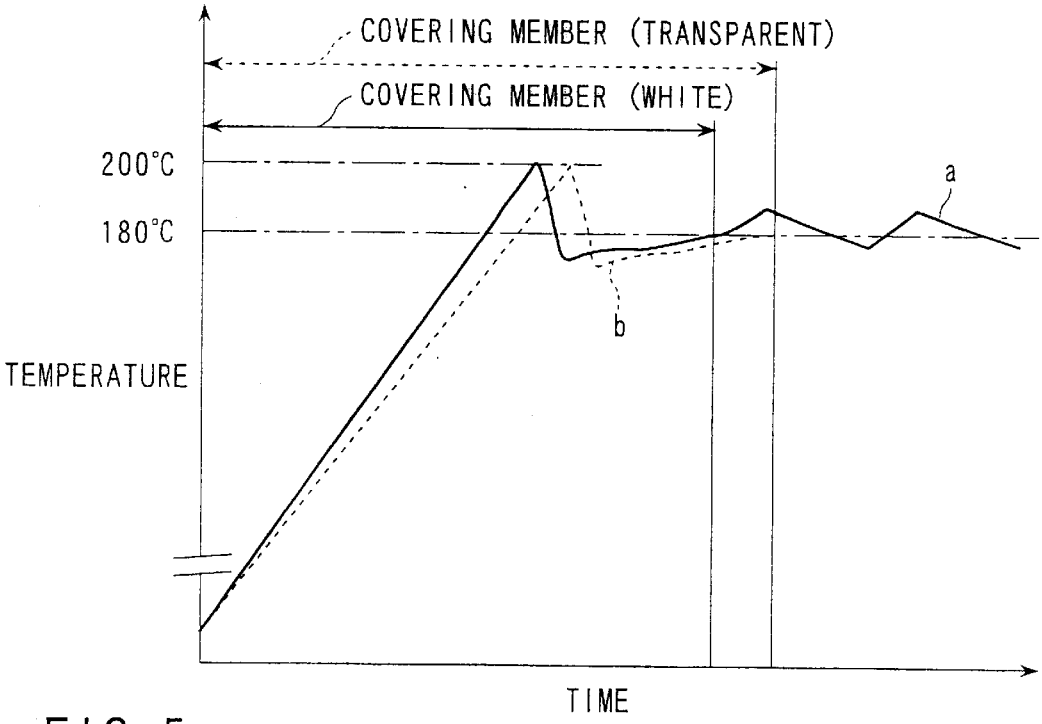
FIG. 5 is a graph showing the temperature elevation characteristics at the rising time (initiation of power supply) of the fixing apparatus shown in FIG. 2.

In many cases, temperature of the heating roller 2 is once elevated from room temperature to a temperature higher than 180° C., followed by repeating the heat dissipation (stop of current supply to the exciting coil 11) and the heating (current supply to the coil 11) so as to control the surface temperature of the heating roller 2 at about 180° C., as shown in FIG. 5.

In accordance with the temperature elevation on the surface of the heating roller 2, heat is generated as an infrared ray from the surface of the heating roller 2. Needless to say, if heat is emitted from the heating roller 2, the heat energy consumed for the heating of the heating roller 2 is decreased. Therefore, in order to promote the temperature elevation to permit the surface temperature of the heating roller 2 to reach 180° C., it is necessary to decrease the radiation heat generated from the heating roller 2. Such being the situation, the heat radiation toward the outside is suppressed by mounting a heat insulating member on the outside of the heating roller 2 or by molding the case of the fixing apparatus 58.

On the other hand, the heat radiation toward the inside of the heating roller 2 also gives rise to a problem that the radiated heat is absorbed by the covering tube 13 or the exciting coil 11 and, thus, is consumed for the warming of the exciting coil 11 and the covering tube 13. Incidentally, the infrared ray is absorbed by the exciting coil 11 and the covering tube 13 in an amount large enough to lower the temperature rising rate in the case of the heating roller 2 made of a pure iron sheet having a thickness of 1 mm as in this embodiment.

Under the circumstances, the wall thickness of the covering tube 13 is set at 0.3 mm and the covering tube 13 is colored white or gray so as to reflect the infrared ray, as described previously in conjunction with FIGS. 2, 3A and 3B. As a result, the infrared ray radiated inside the heating roller 2 toward the exciting coil 11 is reflected from the covering tube 13. It follows that where the thickness of the covering tube 13 is increased in view of the dielectric strength relative to the exciting coil 11, the thickness of the covering tube 13 can be increased without changing the temperature rising time by coloring the covering tube to facilitate the reflection of the infrared ray.

If the thickness of the covering tube is decreased in an attempt to shorten the time required for the temperature elevation, the heat capacity of the covering tube is decreased and the insulating properties of the covering tube are lowered. As a result, problems are brought about that leakage takes place between the exciting coil 11 and the heating roller 2 and that the covering tube 13 covering the exiting coil 11 is peeled off. However, it is possible to set the thickness of the covering tube at an appropriate value, as required. Incidentally, the covering tube is formed of an electrically insulating material in this embodiment. However, it is also possible to use a heat insulating material for forming the covering tube 13. It is also possible to use a heat insulating material, which exhibits electrical insulating properties and is colored in a color capable of reflecting the infrared ray with a high reflectivity, thereby further shortening the temperature elevation time.

Figure 6A:
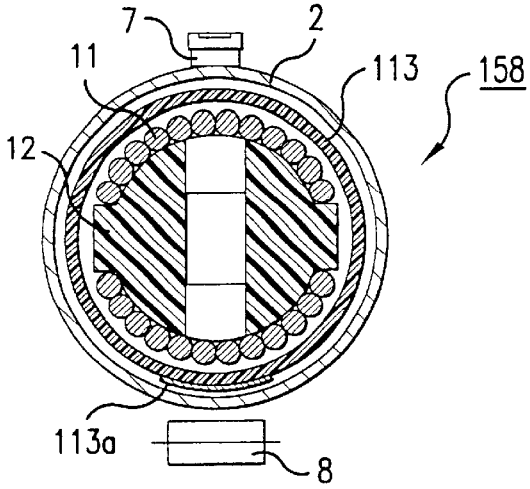
FIG. 6A is a cross sectional view schematically showing another embodiment of the heating roller shown in FIGS. 3A to 3E.

FIG. 6A schematically shows in a magnified fashion a heating roller according to another embodiment of the heating roller shown in FIGS. 3A to 3E. The assembled state into the fixing apparatus is equal to that shown in FIG. 2 and, thus, is omitted.

In the fixing apparatus shown in FIG. 6A, the insulating covering tube 13 covering the exciting coil 11 is arranged between the inner circumferential surface of the heating roller 2 and the exciting coil 11 as in the embodiment shown in FIGS. 3A to 3C.

Figure 6B:
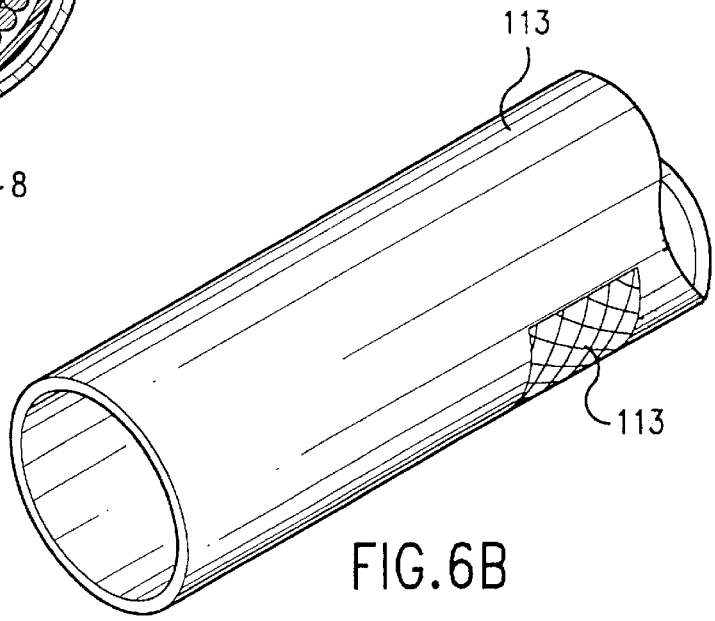
FIG. 6B schematically shows the feature of the tube incorporated in the heating roller shown in FIG. 6A.

As shown in FIG. 6B, the entire region of the insulating covering tube 13 is transparent as in the covering tube used in the known fixing apparatus. However, a region 19 of a predetermined size in the vicinity of the region facing the abnormal temperature detecting mechanism, i.e., the thermostat 8, shown in FIG. 6A is formed of fluorocarbon resin or another kind of coating material that is resistant to a temperature up to 250° C. The region 19 is colored white or gray having a high reflectivity of the infrared ray emitted from the heating roller 2 toward the inside. The region 19 is made alternative to the above structure, a sheet-like metallic material may be adhered an adhesive. In this case, the metallic material has a surface roughness Rz of not more than 6.3 μm and has a thickness 10 μm or less. More preferably, the thickness of the metallic material of the region 19 is 1 μm or less. The adhesive is resistant to a temperature up to 250° C. Incidentally, the size of the region 13*a* having a high reflectivity is, for example, 20 mm×30 mm.

As shown in FIGS. 6A and 6B, the infrared ray reflectivity is increased in the present invention in that region on the circumferential surface of the covering tube 113 covering the exciting coil which is positioned to face the thermostat 8 and in the region 113*a* of the covering tube 113. This is effective for stopping the current supply to the exciting coil 11 in a short time in the case where it has become impossible to detect accurately the surface temperature of the heating roller 2 because, for example, the thermistor 7 exhibited an abnormality or the electric wire has been broken. To be more specific, where an abnormality has taken place that the surface temperature of the heating roller 2 has been undesirably elevated because of, for example, disorder of the thermistor 7, the abnormal temperature elevation on the surface of the heating roller 2 is promptly detected and the power supply to the exciting coil 11 is stopped so as to prevent the releasing layer formed on the surface of the metal (conductor) layer of the heating roller 2 and the covering layer of the exciting coil 11 from being damaged by the high temperature and to prevent the core wire of the exciting coil 11 from being broken, thereby suppressing the damage done to the fixing apparatus 158 to the minimum level. It should also be noted that the abnormality of the thermistor 7 is detected at a relatively low temperature close to the ordinary surface temperature of the roller. It follows that, where, for example, a paper sheet P is caught by the fixing apparatus, it is possible to prevent the paper sheet P from being heated to an abnormally high temperature, with the result that the paper sheet P is prevented from flaming. Incidentally, where the rotation of the heating roller 2 is stopped at the rising time, the surface temperature in that portion of the heating roller 2 which faces the thermostat 8 is heated before the other portion is heated, making it possible to shorten the time required for detecting the abnormality in the position of the thermostat 8. In other words, the detecting speed is increased.

To be more specific, in the fixing apparatus 158 shown in FIGS. 6A and 6B, the region 19 of the covering tube 13 positioned to face that region of the heating roller 2 in which the thermostat 8 is arranged is colored white or gray so as to improve the infrared ray reflectivity. As a result, the infrared ray emitted from the surface of the heating roller 2 toward the inside is effectively reflected from the region 19 of the covering tube 13, compared with the other region, so as to heat the metal layer of the heating roller 2 positioned outside the covering tube 13 in a short time. It follows that the surface temperature in that region of the heating roller 2 which faces the thermostat 8 is heated before the other region. As a result, where the surface temperature of the heating roller 2 continues to be elevated in an uncontrollable state because of the occurrence of an abnormality of the thermistor 7, the abnormality of the thermistor 7 can be detected at a relatively low temperature close to the ordinary surface temperature of the heating roller 2.

It has been confirmed that, if the thermistor 7 operates normally in the temperature range (about 180° C.) actually employed in the fixing step, the elevation of the surface temperature in the region facing the thermostat 8 is lower than the temperature at which the thermostat 8 detects an abnormality and, thus, the fixing operation is not affected.

Figure 7A:
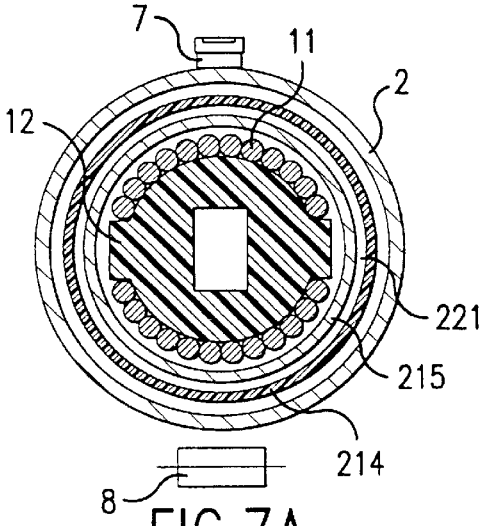
FIG. 7A is a cross sectional view schematically showing another embodiment of the heating roller shown in FIGS. 3A to 3E, 6A and 6B.
Figure 7C:
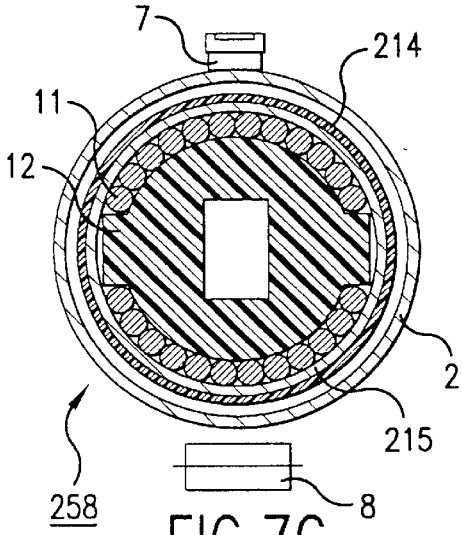
FIG. 7C schematically shows a modification of the heating roller shown in FIG. 7A.
Figure 7B:
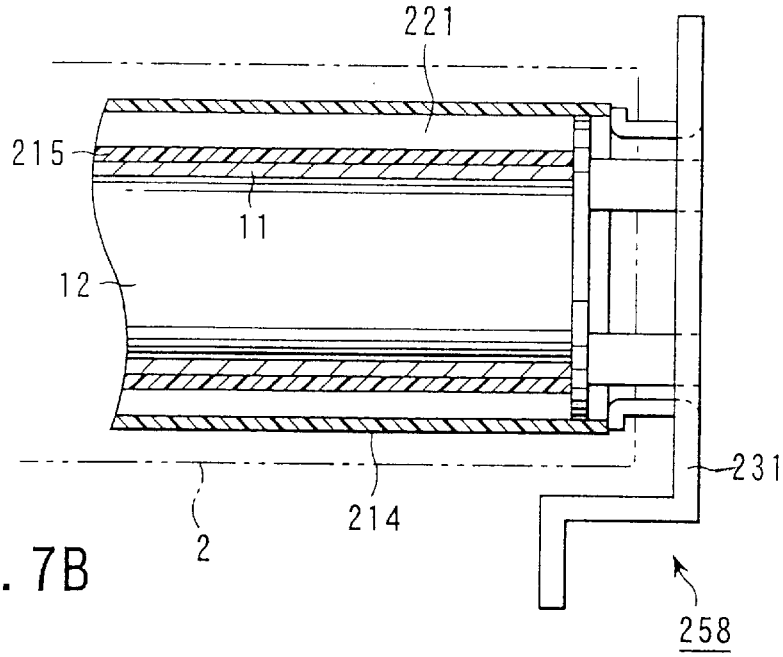
FIG. 7B schematically shows the supporting mechanism of the tube arranged within the heating roller shown in FIG. 7A.

FIGS. 7A and 7B schematically show collectively in a magnified fashion another embodiment of the heating roller shown in FIGS. 3A to 3E, 6A and 6B. The assembled state in the fixing apparatus is equal to that shown in FIG. 2 and, thus, is omitted.

As shown in FIG. 7A, arranged inside the heating roller 2 of a fixing apparatus 258 are the exciting coil 11 wound about the supporting member 12, a first covering member 214 arranged between the exciting coil 11 and the inner wall of the heating roller 2 and positioned on the side of the inner wall of the heating roller 2, and a second covering member 215 on the side of the coil positioned between the first covering member 214 and the exciting coil 11. Where an air layer 221 is interposed between the first covering layer 214 and the second covering layer 215, the first covering layer 214 is not brought into contact with the exciting coil 11 and is fixed to a plate metal 231 positioned on the outside of the fixing apparatus 258, as shown in FIG. 7B. Also, it is possible to arrange these covering members 214 and 215 in contact with each other, as shown in FIG. 7C.

Each of the first and second covering members 214 and 215 is formed of an insulating resin tube, and these covering members 214 and 215 are positioned a predetermined distance apart from each other within the heating roller 2. Incidentally, it is possible to use the first covering member 214 mainly for maintaining, for example, the insulating properties and to use the second covering member 215 for the heat insulation between, for example, the exciting coil 11 and the heating roller 2. It follows that it is possible for the first covering member 214 and the second covering member 215 to be formed of the same material or to be formed of different materials excellent in the heat insulating properties and the electrical insulating properties. In the example shown in FIGS. 7A to 7C, the first and second covering members 214 and 215 are formed of the same material.

Figure 7D:
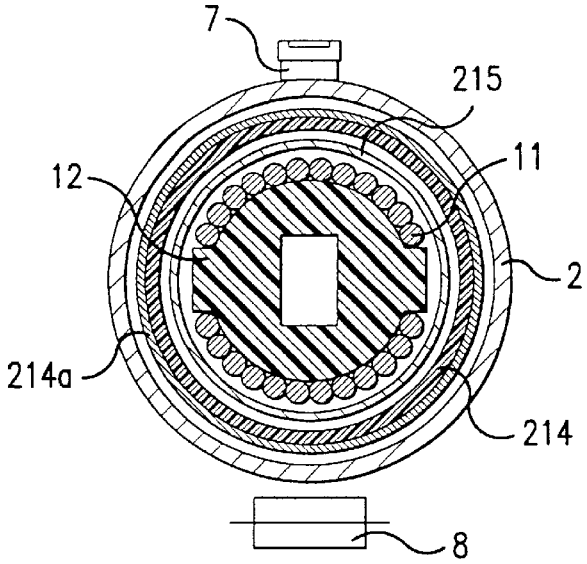
FIG. 7D schematically shows a modification of the heating roller shown in FIG. 7A.
Figure 7E:
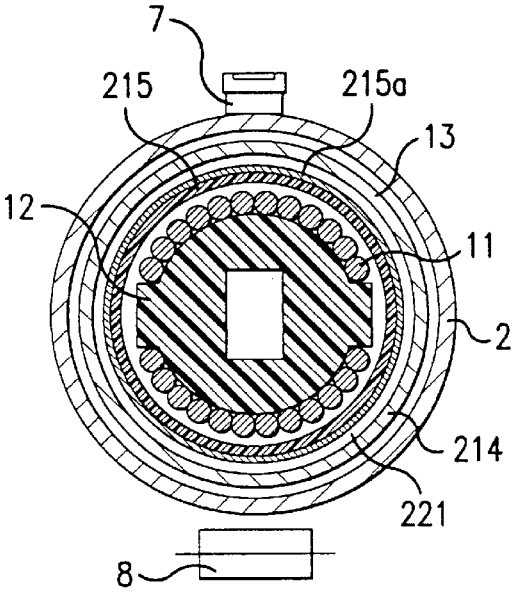
FIG. 7E schematically shows a modification of the heating roller shown in FIG. 7A.
Figure 7F:
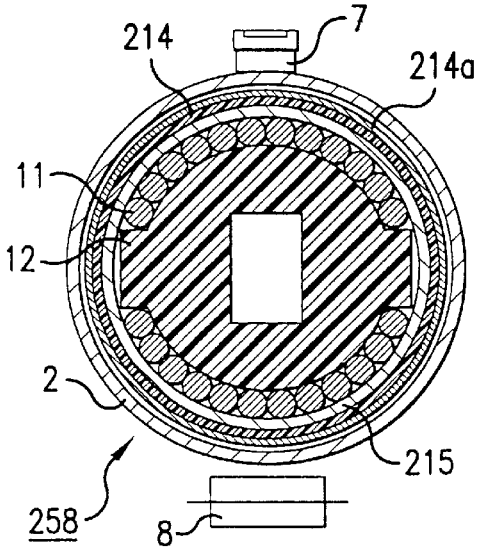
FIG. 7F schematically shows a modification of the heating roller shown in FIG. 7C.

FIGS. 7D to 7F show still other modifications of the covering member (tube) described above with reference to FIGS. 7A and 7C. FIGS. 7D to 7F show a case where at least one of the covering members 214 and 215 is provided with a metallic layer. The metallic layer is integral with the covering member, has a predetermined thickness and is capable of reflecting infrared rays. In the case shown in FIG. 7D, a metallic layer 214*a* is integrally formed on the outer surface of the tube 214. In the case shown in FIG. 7E, a metallic layer 215*a* is formed on the outer surface of the inner tube 215. In the case shown in FIG. 7F, a metallic layer 214*a* is integrally formed on the outer one of the tubes 214 and 215 shown in FIG. 7C. As described above with reference to FIGS. 3D and 3E, the thickness of each metallic layers 214*a* and 215*a* is 10 μm or less. More preferably, the thickness of each of the metallic layers 214*a* and 215*a* is 1 μm or less.

Each metallic layers 214*a* and 215*a* is formed on the surface of a tube by vapor deposition or the like, and the formation is continued until each metallic layer has its desirable thickness, preferably.

The surface of each metallic layer, particularly that of layer 214*a*, is preferably a mirror-like surface capable of reflecting heat (infrared rays) with high efficiency. To be more specific, it is preferable that the surface of each metallic layer have a surface roughness Rz of not more than 6.3 $\mu$m.

As shown in FIGS. 7A to 7F, the covering members arranged between the heating roller 2 and the exciting coil 11 are formed of a material having a low unit cost and selected in view of only the heat insulating properties and a material having high electric insulating properties and selected in view of only the electric insulating properties so as to enable the covering members to perform different functions. In this case, it is possible to suppress the total cost, compared with the case of preparing covering members excellent in both the heat insulating properties and electric insulating properties with a predetermined thickness of each of the covering members.

Also, since there is a combination that permits suppressing the heat capacity, it is possible to suppress the rising time, compared with the case of using a single covering layer of a predetermined thickness as described previously with reference to FIGS. 3A to 3E, 6A, and 6B.

It should also be noted that, since the heat insulating effect can be produced by the air layer interposed between the first covering member 214 and the second covering layer 215, it is possible to make the sum of the thicknesses of the two covering members smaller than the thickness of the single covering layer. Also, as described previously, it is desirable for the covering members to be colored white or gray so as to increase the reflectivity of the infrared ray.

As described above, this embodiment enables the covering member for insulating the exciting coil 11 to be small in heat capacity and excellent in both the electrical insulating properties and the heat insulating properties so as to shorten the rising time. Also, since the infrared ray radiated from the heating roller 2 is shielded as much as possible so as to prevent the heat from being transmitted to the exciting coil 11, it is possible to prevent the problem inherent in the prior art that heat is transmitted to the exciting coil 11 so as to elevate the temperature of the exciting coil 11 and, thus, to increase the copper loss, thereby leading to a low heat generating efficiency. In other words, the apparatus in this embodiment of the present invention permits improving the heat generating efficiency from the exciting coil 11.

Figure 8:
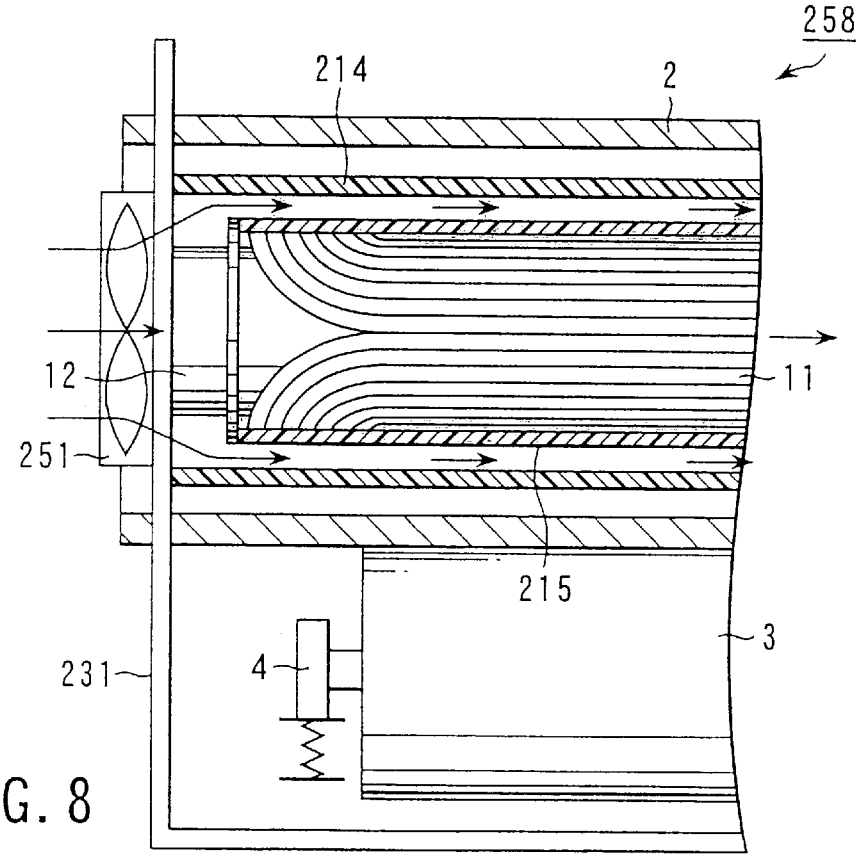
FIG. 8 schematically shows a modification of the fixing apparatus having the heating roller shown in FIG. 7A.

FIG. 8, which is a cross sectional view, as viewed in the planar direction, of the heating roller shown in FIG. 7A, shows a modification of the fixing apparatus having the heating roller shown in FIG. 7A. The fixing apparatus shown in FIG. 8 is featured in that, in the fixing apparatus 258 having the heating roller 2, which is shown in FIG. 7A, a cooling air is supplied by a cooling fan 251 into an air gap 221 interposed between the first covering member 214 positioned on the side of the inner wall of the heating roller 2 and the second covering member 215 positioned on the side of the exciting coil 11, said first covering member 214 being positioned between exciting coil 11 wound about the support member 12 inside the heating roller 2 and the inner wall of the heating roller 2, and said second covering member 215 being positioned between the first covering member 214 and the exciting coil 11 as described previously. The cooling fan 251 is simply fixed to, for example, the sheet plate 231 shown in FIG. 7B by a known fixing method.

As shown in FIG. 8, the exciting coil 11 can be cooled by producing an air stream by the cooling fan 251 within the space between the two covering layers 214 and 215 covering the exciting coil 11 within the heating roller 2. It should be noted that the cooling air is not blown directly against the exciting coil 11. In the present invention, the cooling air is allowed to flow through the clearance between the first covering layer 214 and the second covering layer 215 so as to cool the surrounding region of the exciting coil 11 without adversely affecting the core material of the exciting coil 11, i.e., the adhesive layer (not shown) bonded to the support member 12, and without partially cooling the exciting coil 11 so as to affect the covering layers of the insulated wires forming the exciting coil 11. It should also be noted that, since a cooling air is allowed to flow through the clearance between the two covering layers 214 and 215, the dust, metal piece, etc. floating in the air are prevented by the cooling air from being attached to the exciting coil 11. In addition, the life of the exciting coil 11 is not adversely affected.

Figure 9B:
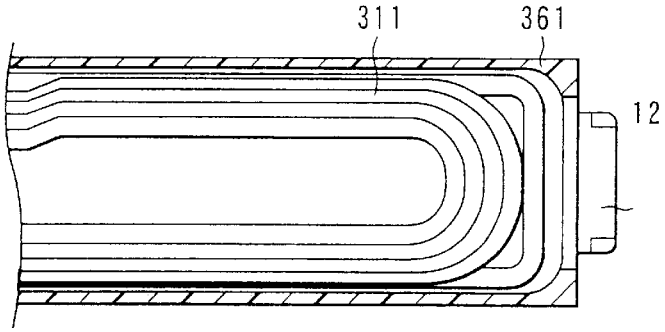
FIGS. 9A, 9B and 9C collectively show schematically another embodiment of the heating roller shown in FIGS. 3A to 3E, 6A, 6B, 7A to 7E and 8.
Figure 9C:
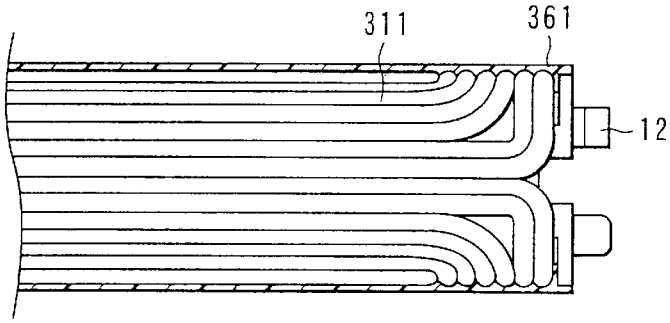
Figure 9A:
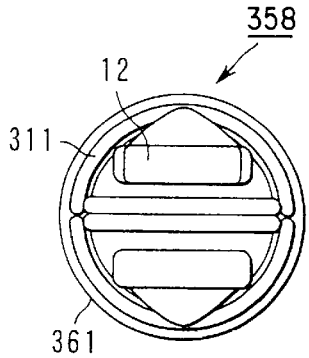

FIGS. 9A, 9B and 9C schematically show in a magnified fashion another embodiment of the heating roller shown in FIGS. 3A to 3E, 6A, and 6B, 7A to 7F and 8. In a fixing apparatus 358 shown in FIGS. 9A, 9B and 9C, the exciting coil 311 is formed of a Litz wire prepared by bundling 16 wires each insulated with polyimide, as in the fixing apparatus described previously. The exciting coil 311 itself is wound about a core material, i.e., the supporting member 12. As described previously, the supporting member 12 is made of an engineering plastic material having a high resistance to heat.

The exciting coil 311 is prepared by winding a Litz wire made of, for example, enamel copper wires about the supporting member 12, followed by fixing the supporting member 12 with an adhesive (not shown) and subsequently solidifying the entire exciting coil 311 with a varnish for increasing the dielectric strength or with an adhesive 361. Incidentally, the adhesive layer 361 is colored, for example, white so as to enable the adhesive layer 361 itself to produce a strong reflectivity of the infrared ray. As a result, the exciting coil 311 itself is capable of efficiently reflecting the infrared ray emitted inward from the heating roller 2 toward the heating roller 2. It follows that it is possible to suppress the heating of the exciting coil 311 itself and to shorten the time required for the temperature elevation of the heating roller 2.

Also, a silicone series adhesive is used for forming the adhesive layer 361 in view of the heat resistance of the adhesive layer 361. However, it is also possible to use a white or gray heat resistant paint for forming the adhesive layer 361, with substantially the same effect. Incidentally, it is effective to use $TiO_2$ (titanium oxide) for coloring the adhesive layer 361 white.

Figure 10:
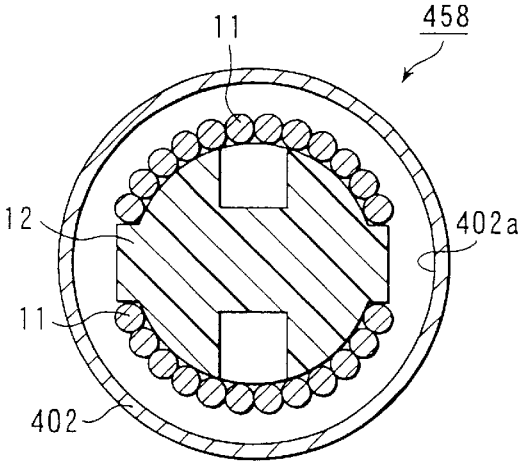
FIG. 10 schematically shows in a magnified fashion the heating roller used in a fixing apparatus differing from any of the various fixing apparatuses shown in other drawings.

FIG. 10 schematically shows in a magnified fashion a heating roller 402 used in a fixing apparatus differing from the various fixing apparatuses described herein before. The assembled state in a fixing apparatus is equal to that shown in FIG. 2 and, thus, is omitted.

As shown in FIG. 10, the heating roller 402 incorporated in a fixing apparatus 458 is featured in that a mirror polishing treatment is applied to the entire region of the inner circumferential surface of the heating roller 402 itself. Incidentally, the exciting coil inserted into the heating roller 402 is prepared by winding a Litz wire about the supporting member 12 as described previously in conjunction with, for example, FIGS. 9A, 9B and 9C. It is possible to utilize an exciting coil 311 having the surface covered with an adhesive layer 361. Needless to say, it is possible to utilize various types of exciting coils covered with the covering tubes described previously.

Figure 11:
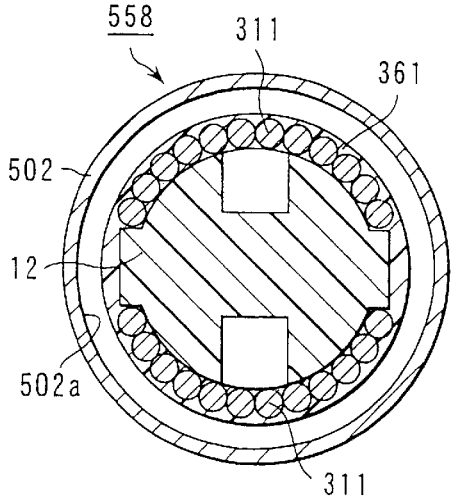
FIG. 11 schematically shows a modification of the fixing apparatus shown in FIG. 10.

Also, in place of applying a mirror polishing treatment to the inner circumferential surface of the heating roller 402 shown in FIG. 10, it is possible to coat the inner circumferential surface of the heating roller 502 with, for example, a white paint 502*a* containing, for example, $TiO_2$ so as to permit the infrared ray emitted from the heating roller toward the inside of the heating roller to be reflected in the thickness direction of the heating roller of a fixing apparatus 558, as shown in FIG. 11. In the example shown in FIG. 11, the covering tube 13 is mounted around the adhesive layer 361 serving to fix the exciting coil 311.

It is possible to suppress the heating of the exciting coil and to increase the life of the exciting coil by applying a mirror polishing treatment to the inner circumferential surface of the heating roller and by arranging a reflecting member for reflecting the heat flowing toward the inside of the roller in the thickness direction of the heating roller, as shown in FIGS. 10 and 11. Incidentally, where a mirror polishing treatment is applied to the inner circumferential surface of the heating roller or where the inner circumferential surface of the heating roller is colored in a manner to increase the infrared ray reflectivity in a fixing apparatus in which the heating roller is heated by a known halogen lamp, it is known to the art that the infrared ray generated from the halogen lamp is reflected so as to be absorbed by the halogen lamp, with the result that the halogen lamp is broken. In other words, it is effective to apply a mirror polishing treatment to the inner circumferential surface of the heating roller or to color the inner circumferential surface of the heating roller in a manner to improve the infrared ray reflectivity when it comes to the heating roller included in a fixing apparatus of an induction heating system as in the present invention shown in FIGS. 10 and 11.

Figure 12:
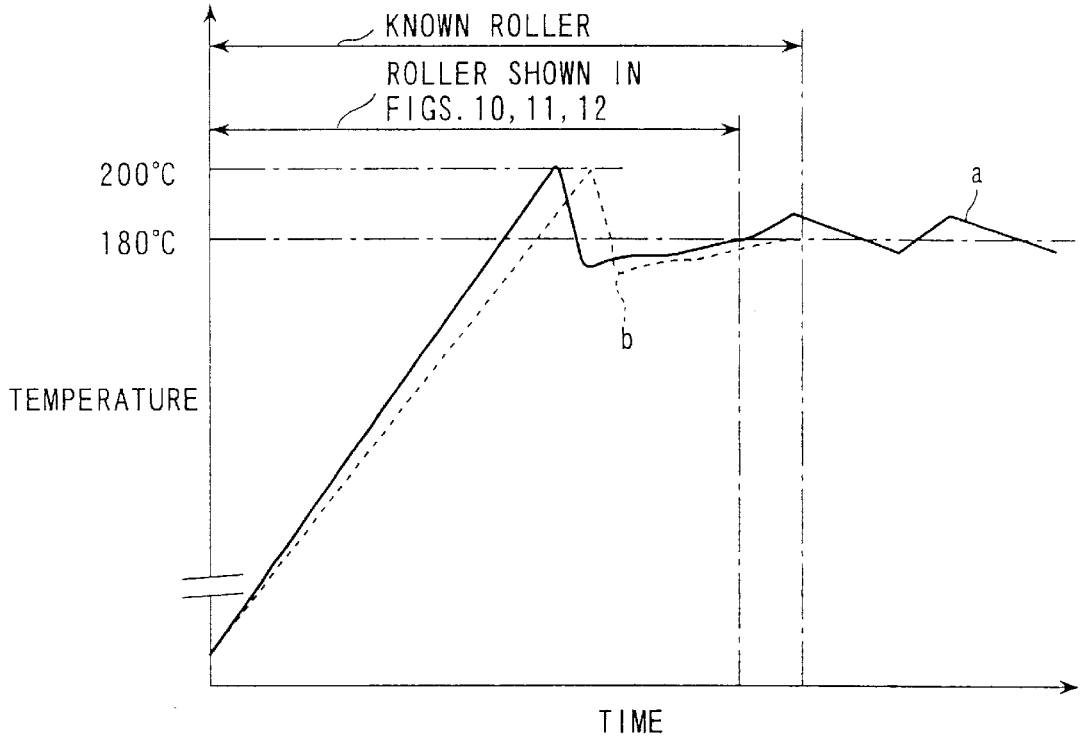
FIG. 12 schematically shows a modification of the heating roller shown in FIGS. 9A, 9B, 9C, 10, 11 and 12.

FIG. 12 schematically shows another modification of the heating roller shown in FIGS. 9A, 9B, 9C, 10 and 11. In the heating roller of a fixing apparatus 658 shown in FIG. 12, the exciting coil 311 having the surface covered with the adhesive layer 361 as shown in FIGS. 9A to 9C is arranged inside the heating roller 2 as shown in FIG. 3A, in which the covering tube 13 is arranged.

According to the heating roller shown in FIG. 12, the heat generated from the metal layer of the heating roller 2 heated by the eddy current radiated from the exciting coil 11 is prevented by the covering tube 13 and the adhesive layer 361 from being brought back to the exciting coil 11 so as to make it possible to further shorten the time between the initiation of the current supply to the exciting coil 11 and the temperature elevation of the heating roller to a predetermined temperature.

Figure 13:
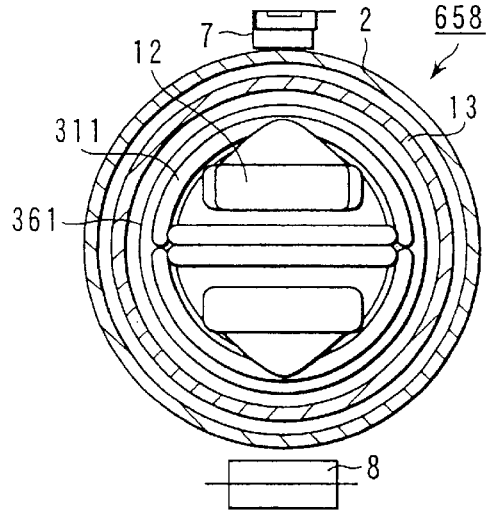
FIG. 13 is a graph showing the temperature elevation characteristics at the rising time (initiation of power supply) of the fixing apparatus shown in FIG. 10.

As described above, a mirror surface 402*a* having the surface properties that the infrared ray radiated from the heating roller 2 is unlikely to be radiated toward inner region of the heating roller is formed on the inner surface of the heating roller 402 so as to inhibit the radiation of the infrared ray toward the inner region of the heating roller. As a result, it is possible to shorten the time required for the rising by about 5 seconds (about 15%) as shown by curve (solid line) a in FIG. 13, compared with the case of using the conventional heating roller denoted by curve (broken line) b in FIG. 13.

In the present invention, it is possible to shorten the rising time of the fixing apparatus by the various embodiments of the fixing apparatus of the present invention and by combination of some of these embodiments while maintaining insulating properties and safety. Also, the heat efficiency can be improved by suppressing the heat radiated toward the exciting coil.

As described above in detail, the fixing apparatus of the present invention makes it possible to shorten the rising time for elevating the temperature of the cylindrical metal layer from the state of stopping the current supply to the cylindrical metal layer to a predetermined temperature (i.e., the rising time between the initiation of the current supply and the temperature elevation to a predetermined level) in the step of fixing the toner image transferred to a paper sheet to the paper sheet by elevating the temperature of the cylindrical roller having a thin metal layer by an induction heating.

It should also be noted that, in the present invention, a covering material having a small heat capacity and exhibiting heat insulating properties and electrical insulating properties is arranged in the space between the exciting coil arranged within the heating roller and the inner wall of the heating roller, making it possible to ensure high insulating properties without increasing the rising time.

On the other hand, the covering material is formed of a thin covering material having a small heat capacity and exhibiting at least insulating properties. In addition, an air layer is formed between the two covering material layers so as to decrease the cost of the covering material layers.

The particular constructions of the present invention described above make it possible to provide a fixing apparatus having a short warm up time, exhibiting sufficient electrical insulating properties and heat insulating properties between the exciting coil and the heating roller, and capable of saving the power consumption.

What is claimed is:

1. A fixing apparatus, comprising:

a first hollow cylindrical roller rotatable in an optional direction;

a second roller brought into contact with a nip portion on the outer circumferential surface of said first hollow cylindrical roller with a predetermined contact pressure so as to be rotated in accordance with rotation of the first hollow cylindrical roller, the nip portion into which a transferred material is supplied;

an induction heating apparatus arranged within the first hollow cylindrical roller so as to impart a magnetic flux to the first hollow cylindrical roller and, thus, to generate an eddy current within the first roller, thereby generating heat; and a covering member having a predetermined color effective for reflecting an infrared ray radiated from the first hollow cylindrical roller and arranged between the first hollow cylindrical roller and said induction heating apparatus so as to prevent the first hollow cylindrical roller from being brought into direct contact with the induction heating apparatus, wherein a moving amount and moving direction of said covering member are limited by a core member for supporting a coil member of said induction heating apparatus.

2. The fixing apparatus according to claim 1, wherein said covering member is formed into a tubular form having a diameter smaller than the outer diameter of the coil member.

3. The fixing apparatus according to claim 1, further comprising:

a first temperature detecting mechanism for detecting the surface temperature of said first roller; and a second temperature detecting mechanism for detecting an abnormality of said first temperature detecting mechanism by detecting the surface temperature of the first roller.

4. The fixing apparatus according to claim 1, further comprising:

a coil member support member for supporting a the coil member of said induction heating apparatus; and an adhesive layer for fixing the coil member to the coil member supporting member, wherein said adhesive layer is colored white.

5. A fixing apparatus, comprising:

a first hollow cylindrical roller rotatable in an optional direction;

a second roller brought into contact with a nip portion on the outer circumferential surface of said first hollow cylindrical roller with a predetermined contact pressure so as to be rotated in accordance with rotation of the first hollow cylindrical roller, the nip portion into which a transferred material is supplied;

an induction heating apparatus arranged within the first hollow cylindrical roller so as to impart a magnetic flux to the first hollow cylindrical roller and, thus, to generate an eddy current within the first roller, thereby generating heat; and a covering member having a predetermined color effective for reflecting an infrared ray radiated from the first hollow cylindrical roller and arranged between the first hollow cylindrical roller and said induction heating apparatus so as to prevent the first hollow cylindrical roller from being brought into direct contact with the induction heating apparatus, wherein said covering member has a thickness of at least 0.1 mm.

6. The fixing apparatus according to claim 5, wherein said covering member exhibits insulating properties and a predetermined color effective for reflecting the infrared ray is imparted to a position corresponding to a region in the vicinity of the position where at least said second temperature detecting mechanism is positioned on the outer circumferential surface of said first roller.

7. The fixing apparatus according to claim 5, wherein said covering member is at least one of colored white or gray.

8. The fixing apparatus according to claim 5, wherein said covering member has a metal surface member.

9. The fixing apparatus according to claim 8, wherein the metal surface member has a thickness of 10 $\mu$m or less.

10. The fixing apparatus according to claim 5, wherein said covering member is formed of a heat insulating material.

11. A fixing apparatus, comprising:

a first hollow cylindrical roller rotatable in an optional direction;

a second roller brought into contact with a nip portion on the outer circumferential surface of said first hollow cylindrical roller with a predetermined contact pressure so as to be rotated in accordance with rotation of the first hollow cylindrical roller, the nip portion into which a transferred material is supplied;

an induction heating apparatus arranged within the first hollow cylindrical roller so as to impart a magnetic flux to the first hollow cylindrical roller and, thus, to generate an eddy current within the first hollow cylindrical roller, thereby generating heat;

a first covering member having a predetermined color effective for reflecting an infrared ray and arranged in the free space between the first hollow cylindrical roller and said induction heating apparatus so as to prevent the first hollow cylindrical roller from being brought into direct contact with the induction heating apparatus; and a second covering member having a predetermined color effective for reflecting an infrared ray and arranged in the free space between the first covering member and the induction heating apparatus so as to prevent the first hollow cylindrical roller from being brought into direct contact with the induction heating apparatus, wherein at least one of said first covering member and said second covering member is formed of a thermally shrinkable resin.

12. The fixing apparatus according to claim 11, wherein at least one of said first covering member and said second covering member exhibits electrical insulating properties.

13. The fixing apparatus according to claim 11, wherein at least one of said first covering member and said second covering member exhibits heat insulating properties.

14. The fixing apparatus according to claim 11, wherein at least one of said first covering member and said second covering member is colored white.

15. The fixing apparatus according to claim 11, further comprising:

an air layer is formed between said first covering member and said second covering member.

16. The fixing apparatus according to claim 15, wherein an air stream is formed in said air layer.

17. A fixing apparatus for use in an electrophotographic apparatus, in which an AC current is supplied to an electromagnetic induction coil arranged in close proximity to an endless member having a metal layer formed of a conductor so as to generate heat in said endless member for heating a transferred material to which a toner image is fixed, comprising:

a coil member supporting member for supporting the electromagnetic induction coil; and an adhesive layer for fixing a coil member to said coil member supporting member, wherein said adhesive layer contains titanium oxide to color the adhesive layer white.

18. The fixing apparatus according to claim 17, wherein a mirror polishing treatment is applied to the inner surface of said endless member.

* * * * *